United States Patent [19]

Hedberg

[11] 3,931,968

[45] Jan. 13, 1976

[54] ADJUSTABLE TENNIS RACKET HANDLE

[76] Inventor: John K. Hedberg, 4970 Lowell Blvd., Denver, Colo. 80221

[22] Filed: May 13, 1974

[21] Appl. No.: 469,705

[52] U.S. Cl. ..... 273/75; 273/73 J; 273/81.2

[51] Int. Cl.[2] ..... A63B 49/08

[58] Field of Search ..... 273/75, 73 J, 81.2, 80 D, 273/1.5 R

[56] References Cited

UNITED STATES PATENTS

| | | | |
|---|---|---|---|
| 1,253,700 | 1/1918 | McLaughlin | 273/812 UX |
| 2,379,572 | 7/1945 | Gibson | 273/1.5 R X |
| 3,534,960 | 10/1970 | Hanks | 273/75 |
| 3,560,033 | 2/1971 | Barkus | 273/81.2 UX |
| 3,674,267 | 7/1972 | Hollis | 273/75 |

FOREIGN PATENTS OR APPLICATIONS

| | | | |
|---|---|---|---|
| 772,931 | 4/1957 | United Kingdom | 273/81.2 |

*Primary Examiner*—Paul E. Shapiro
*Attorney, Agent, or Firm*—Bacon & Thomas

[57] ABSTRACT

A tennis racket handle is slidably adjustable along a shank and a ball movable with the handle is engageable in any of a plurality of longitudinally spaced depressions on the shank. In one form the ball is urged away from the depressions by a spring and can be held in a selected depression only by a firm grip on the handle. In another form a spring and cam normally holds the ball in a selected depression and is released by pressing a button extending to the exterior of the handle.

4 Claims, 10 Drawing Figures

RELEASED

LATCHED

ADJUSTABLE TENNIS RACKET HANDLE

BACKGROUND OF THE INVENTION

This invention is in the field of tennis rackets and particularly tennis rackets having adjustable handles.

It has been proposed heretofore to construct tennis rackets wherein the length of the handle could be adjusted by moving the handle grip along the shank to a desired position. However, all such prior proposals involve the use of screws or the like rendering the adjustment semi-permanent and incapable of being rapidly readjusted without the use of tools or such accessory devices.

SUMMARY OF THE INVENTION

The present invention involves an adjustable tennis racket wherein the hand grip portion may be rapidly moved along the shank to adjust the handle length to that desired very rapidly and without the use of any tools, relying only on the hand of the player that then grips the handle.

It is, therefore, a principal object of this invention to provide a tennis racket having an adjustable handle, the length of which may be rapidly adjusted during play of a game and even while the game ball is in motion.

DESCRIPTION OF THE PREFERRED EMBODIMENTS

Figure 1:
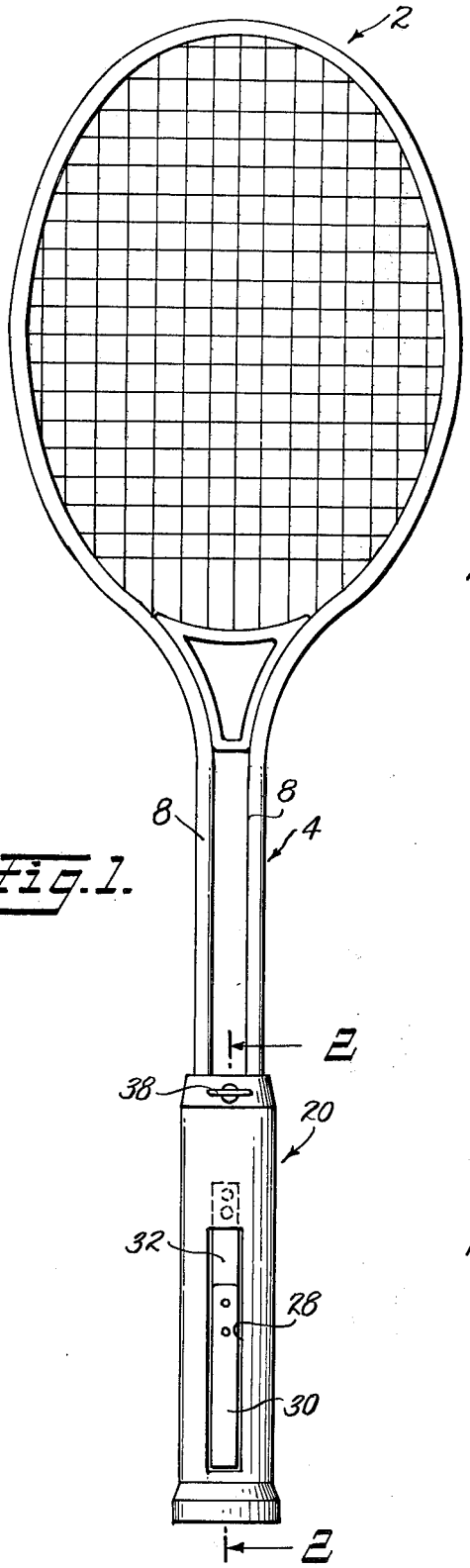
FIG. 1 is a plan view of a racket with an adjustable handle according to the present invention, the handle wrapping being omitted.
Figure 4:
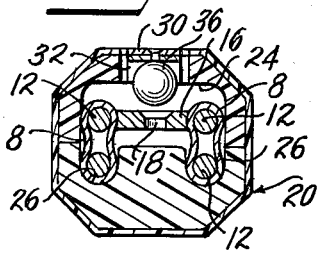
FIG. 4 is a transverse sectional view, taken on the line 4—4 of FIG. 3.

Referring first to FIGS. 1 to 4, there is shown therein a first embodiment of the invention wherein a racket is provided with the usual or conventional head 2 and a handle shank 4. As shown herein, the handle shank 4 has been modified to accommodate the present invention but may otherwise be considered to be conventional having a pair of tubular guide members 8 extending in generally parallel relation outwardly from the head 2. FIG. 4 shows the more or less conventional configuration of the tubular members 8. To adapt a conventional tennis racket to the present invention, the tubular guides 8 were cut as at 10 in FIG. 3 and slidable extensions there are provided by inserting guide rods

Figure 3:
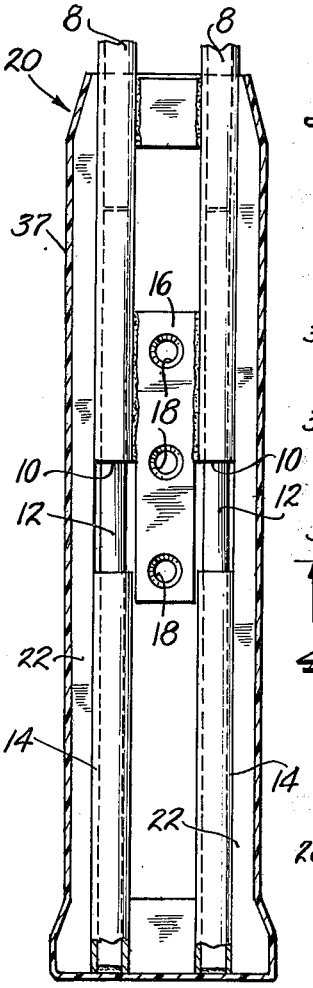
FIG. 3 is a vertical sectional view, taken on the line 3—3 of FIG. 2 and with the handle wrapping in place.
Figure 2:
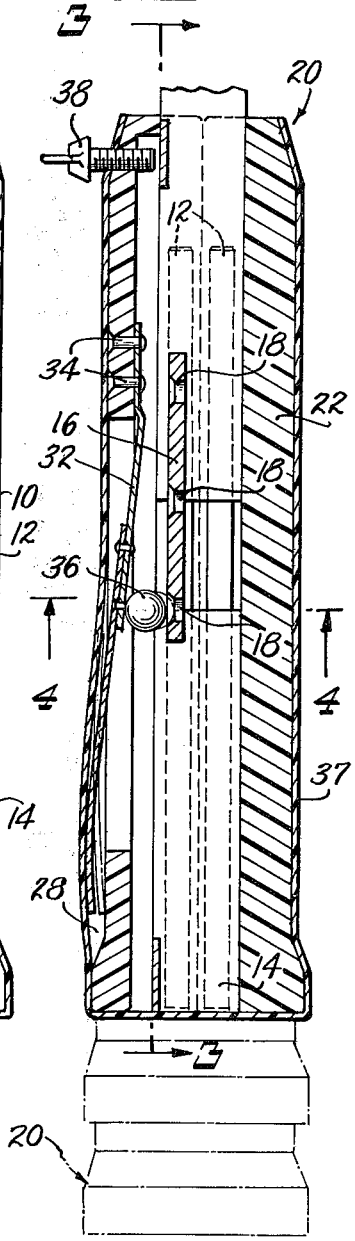
FIG. 2 is an enlarged fragmentary vertical sectional view, taken on the line 2—2 of FIG. 1, showing the adjustable handle in an unlatched position and the latched position being shown by phantom lines.
Figure 5:
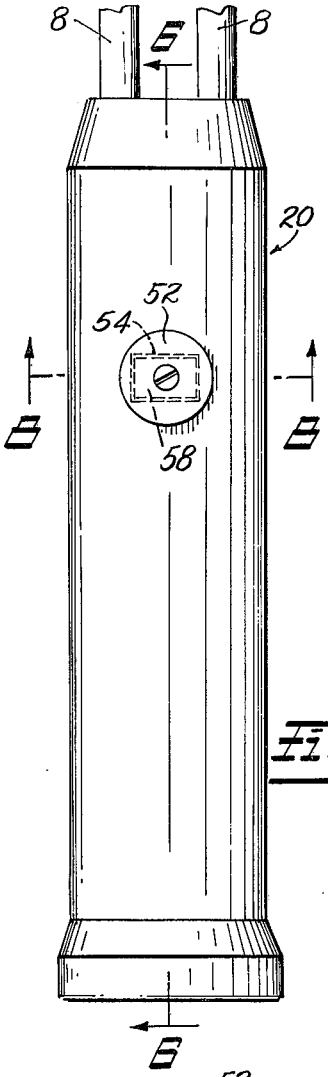
FIG. 5 is a fragmentary plan view of a modified form of an adjustable handle.
Figure 7:
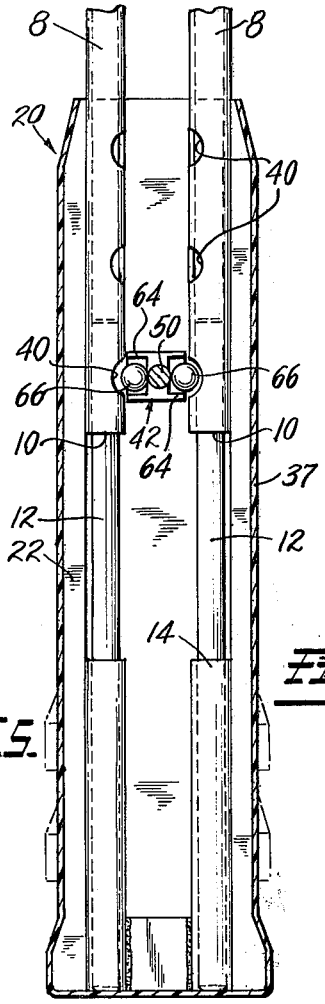
FIG. 7 is a fragmentary vertical sectional view, taken on the line 7—7 of FIG. 6.
Figure 6:
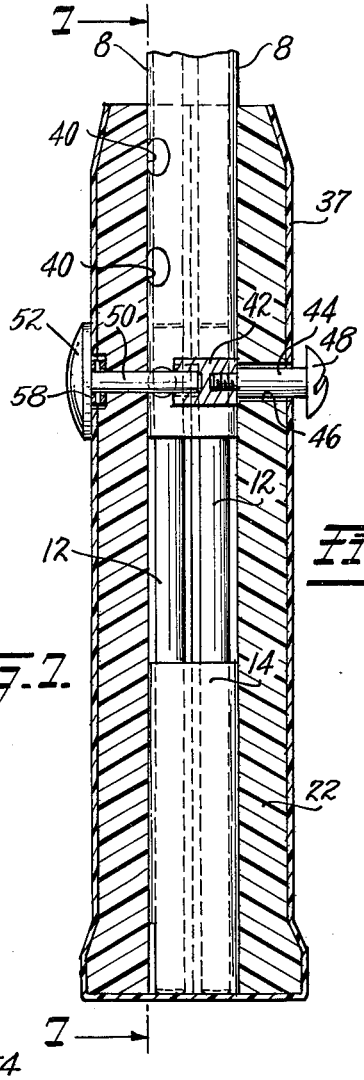
FIG. 6 is a fragmentary vertical, sectional view, taken on the line 6—6 of FIG. 5.

12 slidably therein and fixedly applying the cut lengths 14 of tubular guides to the rods 12. It is to be understood, however, that rather than converting a conventional fixed-handle tennis racket to the present invention, the tubular guides 8 may be initially made of the required length. As shown in FIGS. 2–4, a detent plate 16 is mounted between the tubular guides 8 and suitably fixed thereto as by welding or the like. The detent plate 16 is provided with a plurality of longitudinally spaced openings 18 therein, which openings are preferably countersunk, as shown in FIGS. 2 and 4 to provide firm seats or depressions to receive a latching ball. While the plate 16 is shown as having three such depressions therein, it is to be understood that a greater or lesser number could be provided if desired. The adjustable handle member 20 comprises an inner body member 22, which may be of molded plastic material, having a longitudinal channel 24 therethrough adapted to embrace the guide tubes 8 and, as best shown in FIG. 4, the channel 24 also defines grooves 26 in which the guide tubes 8 are slidably guided. The handle member comprises not only the inner body member 22 but may be said to include a hand grip portion adapted to be gripped by the hand of the user for manipulating the racket. The tubular guides 14 and guide rods 12 are fixed to the handle 20 in any suitable manner. One side of the handle body member 22 is provided with an opening or slot 28 (see FIG. 1) in which an actuating lever 30 is positioned. The lever 30 may be substantially rigid and, if so, is attached to a leaf spring 32, which in turn is secured to the body 22 by rivets 34 or the like and a ball latch member 36 is fixedly mounted on the lever 30 and/or leaf spring 32 in a position directly opposite the depressions 18 in plate 16. If desired, however, the lever 30 could be a portion of leaf spring 32 itself rather than a separate rigid member, as shown. The leaf spring 32 is so configured that it is normally biased outwardly, that is, it normally tends to spring outwardly to withdraw the ball 36 from any depression 18 in which it may be seated. Preferably, the entire handle, including the lever 30, is covered by a flexible hand grip cover 37 which may be of leather or the like and sufficiently flexible to permit the lever to move outwardly to the position shown in full lines in FIG. 2.

The handle portion 20 may also be provided with a wing screw 38 threaded therethrough and which may be tightened to securely clamp the handle to the guide tubes 8 when it is desired that the length of the handle not be adjustable.

In operation, the player may move the handle 20 to the desired position along the shank 4 and then by tightly gripping the handle, the lever 30 will be pushed inwardly to seat ball 36 in a depression 18 and the handle will be held in that adjusted position as long as the player keeps a tight grip on the handle. This form of the invention is valuable in teaching players the importance of a tight grip when playing the game of tennis. Obviously, undue relaxation of the player's grip will permit the handle to become unlatched from the shank and be freely slidable therealong, rendering it difficult or impossible to properly play the game. Also, for the experienced and expert player, it is possible for him to adjust the length of the racket handle during actual playing of the game. That is, if he anticipates that his next return will be from near the net, he may shorten the handle while actually in motion or lengthen the same if he anticipates his return to be from the back court. It is only necessary for the player to relax his grip, thus permitting the spring 32 to retract ball 36 whereupon he may extend or shorten the handle, then restore his grip to latch the handle in adjusted position.

Referring now to FIGS. 5–10, a second embodiment of the invention is shown therein. In this form of the invention, the guide tubes 8 may be considered to be identical to those described with reference to the first embodiment and the handle 20 may be considered to be substantially identical as to its basic structure in that it is provided with a longitudinal channel 24 slidably and guidingly embracing the shank tubes 8. In this embodiment, however, the detent plate 16 previously described is omitted and instead the guide tubes 8 are provided with recesses 40 therein, there being a series of longitudinally spaced recesses in each guide tube 8 which are adapted to receive latching balls, as will be described. The rods 12, which move with the handle, are provided with recesses opposite the balls.

Figure 9:
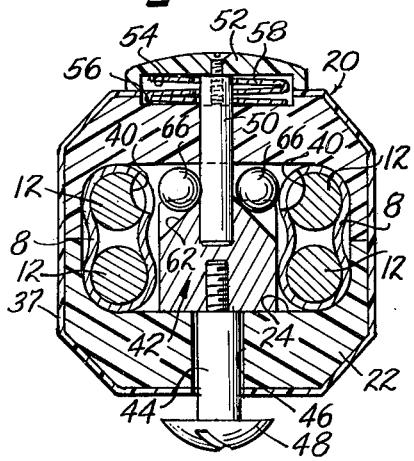
FIG. 9 is a view, similar to FIG. 8, but showing the handle in its released position.
Figure 8:
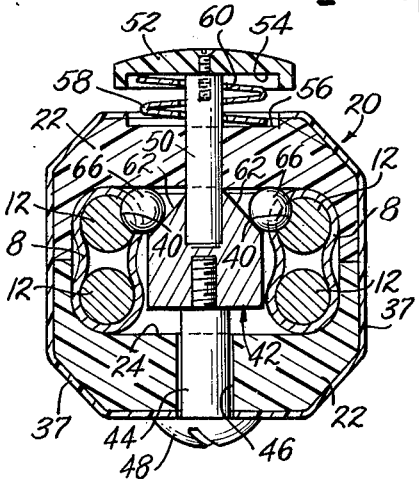
FIG. 8 is an enlarged transverse sectional view, taken on the line 8—8 of FIG. 5, and showing the handle in its latched position.
Figure 10:
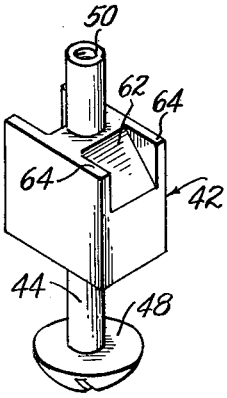
FIG. 10 is an isometric view of the latching cam of the handle.

A cam member 42 is slidably mounted in the handle 20 for movement transversely thereof between the guide tubes 8 by being mounted on a guide pin 44 extending through an opening 46 in the handle and having a head 48 thereon. Also, fixed to the cam member 42 is a rod or pin 50 extending slidably outwardly through the other side of the handle from the pin 44. The rod or pin 50 terminates in an enlarged button-like head 52, fixed thereon, and provided with a recess 54 opposite a recess 56 in the facing portion of the handle 20. Seated in the recesses 54–56 is a Z-shaped leaf spring 58 having openings 60 therethrough and through which the rod 50 slidably extends. It will be apparent that the spring 58 urges the button 52 outwardly and the cam member 42 upwardly, as seen in FIGS. 8 and 9. On its opposite sides the cam member 42 is provided with sloping cam surfaces 62, best seen in FIG. 10. The cam surfaces 62 are bounded by flange portions 64, spaced apart sufficiently to loosely receive latching balls 66. The flanges 64 are of such dimensions that the latching balls 66 will be retained therebetween whether the cam member 42 is in the upper position of FIG. 8 or the lower position of FIG. 9. It is to be noted that, as shown in FIG. 9, the button 52 may be depressed against the action of spring 58 to lower the cam surfaces 62 sufficiently to permit latching balls 66 to fall out of depressions or seats 40 in the guide tubes 8. With the parts in this position, the handle may be readily and freely moved along the shank of the racket to adjust the length of the handle. Then, upon release of the button 52, the spring 58 moves the parts upwardly to the position of FIG. 8 wherein the balls are caused to engage the upper surface of the guide channel 24 and the cam surfaces 68 then force the balls outwardly into the depressions 40 and since the spring holds the parts in that position, the handle 20 is thus releasably latched in adjusted position.

Thus, it is apparent that a player may, by using the thumb or a finger of the hand gripping the racket, depress the button 52 to release the handle from the shank and permit a rapid and easy adjustment of the racket handle length while the game is in progress. Once the handle length has been set as desired, the button may be released and the handle portion then becomes latched to the shank.

In both of the embodiments described, it is to be noted that if the handle length is adjusted and the ball or balls projected toward their respective depressions at a position where they do not register with those depressions, the balls may move along the guide tubes or detent plate, by moving the handle, until a depression is reached and they can then be urged into the described latching position.

While a limited number of embodiments of the invention have been shown and described herein, the same are merely illustrative of the principles involved and the invention extends to all embodiments falling within the scope of the appended claims.

I claim:

1. A tennis racket having a head and a shank fixed thereto;

a handle slidably mounted on said shank for sliding movement thereon toward and from said head and having a hand-grip portion;

interengageable means on said shank and on said handle for releasably latching said handle in each of a plurality of positions along said shank;

said interengageable means on said handle being movably carried thereby for movement thereon toward and from said shank;

resilient means urging said interengageable means on said handle in a direction outwardly of said handle;

manually interengageable means on said hand-grip portion, adjacent the outer surface thereof, positioned to be engageable by the hand of a player gripping said hand-grip portion and being movable to move said interengageable means on said handle against the urging of said resilient means whereby a player may, by manipulating the hand holding the racket, selectively latch or release said handle relative to said shank; and said interengageable means on said shank comprising a plurality of longitudinally spaced depressions therein and wherein said interengageable means on said handle comprises a ball engageable in said depressions to latch said handle against movement, said resilient means being an outwardly biased leaf spring secured at one end thereof to said handle and extending adjacent the outer surface thereof, said ball being fixedly mounted on the other end of said spring whereby a firm grip by the player's hand engages said ball into one of said depressions and thereby holds said handle latched to said shank and whereby relaxation of said grip permits said leaf spring to spring outwardly and withdraw said ball from the depression.

2. A tennis racket as defined in claim 1 including a flexible handle cover overlying said leaf spring and defining said outer surface of said handle.

3. A tennis racket having a head and a shank fixed thereto;

a handle slidably mounted on said shank for sliding movement thereon toward and from said head and having a hand-grip portion;

interengageable means on said shank and on said handle for releasably latching said handle in each of a plurality of positions along said shank;

said interengageable means on said handle being movably carried thereby for movement thereon toward and from said shank;

resilient means urging said interengageable means on said handle in a direction outwardly of said handle;

manually engageable means on said hand-grip portion, adjacent the outer surface thereof, positioned to be engageable by the hand of a player gripping said hand-grip portion and being movable to move said interengageable means on said handle against the urging of said resilient means whereby a player may, by manipulating the hand holding the racket, selectively latch or release said handle relative to said shank;

said interengageable means on said shank comprising a plurality of longitudinally spaced depressions therein and wherein said interengageable means on said hndle comprises a ball engageable in said depressions to latch said handle against movement; and including a cam member slidably mounted in said handle and engageable with said ball to force and hold the same in a selected one of said depressions;

said manually engageable means comprising a button member drivingly connected to said cam member and extending to the exterior of said handle.

4. A tennis racket as defined in claim 3 wherein said resilient means comprises a spring member arranged to urge said button outwardly and said cam member in a direction to force said ball into a depression whereby a finger of a hand gripping said handle may depress said button and thereby permit said ball to leave a depression and thus release said handle to slide along said shank.

* * * * *